US008839759B2

(12) United States Patent
Riegger et al.

(10) Patent No.: US 8,839,759 B2
(45) Date of Patent: Sep. 23, 2014

(54) INTEGRATED EXHAUST MANIFOLD

(75) Inventors: John Christopher Riegger, Ann Arbor, MI (US); Shuya Shark Yamada, Novi, MI (US); Todd Jay Brewer, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1042 days.

(21) Appl. No.: 12/857,349

(22) Filed: Aug. 16, 2010

(65) Prior Publication Data

US 2012/0037101 A1 Feb. 16, 2012

(51) Int. Cl.
*F01N 3/10* (2006.01)

(52) U.S. Cl.
USPC ..... 123/193.6; 60/323

(58) Field of Classification Search
USPC ..... 123/193.5; 60/313, 323
See application file for complete search history.

(56) References Cited

U.S. PATENT DOCUMENTS

| | | | | |
|---|---|---|---|---|
| 2,727,355 | A | 12/1955 | Wosika | |
| 3,488,723 | A | 1/1970 | Veazie | |
| 3,744,463 | A | 7/1973 | McFarland, Jr. | |
| 4,759,181 | A | 7/1988 | Biritz | |
| 4,800,720 | A | 1/1989 | Okada | |
| 4,860,700 | A | 8/1989 | Smith | |
| 5,279,266 | A | 1/1994 | Landfahrer et al. | |
| 6,295,963 | B1 | 10/2001 | Kollock et al. | |
| 6,513,506 | B1 | 2/2003 | Ito et al. | |
| 6,672,296 | B2 | 1/2004 | Ito et al. | |
| 7,367,294 | B2 | 5/2008 | Rozario et al. | |
| 2003/0000211 | A1 | 1/2003 | Drangel et al. | |
| 2003/0061807 | A1 * | 4/2003 | Kim | 60/323 |
| 2004/0020195 | A1 * | 2/2004 | Ashida et al. | 60/302 |
| 2004/0040521 | A1 | 3/2004 | Hardin | |
| 2005/0193966 | A1 | 9/2005 | Mac Vicar et al. | |
| 2007/0215074 | A1 | 9/2007 | Rozario et al. | |
| 2008/0110163 | A1 * | 5/2008 | Nagasaki | 60/323 |
| 2009/0126659 | A1 | 5/2009 | Lester et al. | |
| 2010/0037595 | A1 | 2/2010 | Kaneko et al. | |
| 2010/0126153 | A1 * | 5/2010 | Nagafuchi | 60/299 |
| 2010/0251704 | A1 * | 10/2010 | Asame et al. | 60/323 |

FOREIGN PATENT DOCUMENTS

WO 2009093120 A1 7/2009

OTHER PUBLICATIONS

Riegger, John Christopher et al., "Integrated Exhaust Manifold," U.S. Appl. No. 12/857,349, filed Aug. 16, 2010, 44 pages.

Riegger, John Christopher et al., "Method and System for Controlling Engine Exhaust," U.S. Appl. No. 12/857,302, filed Aug. 16, 2010, 37 pages.

* cited by examiner

*Primary Examiner* — M. McMahon

(74) *Attorney, Agent, or Firm* — Julia Voutyras; Alleman Hall McCoy Russell & Tuttle LLP

(57) ABSTRACT

A cylinder head of an engine with an integrated exhaust manifold is provided. In one example, the inner exhaust runners and outer exhaust runners have different cross-sectional areas. This arrangement may be beneficial to maintain exhaust flow rates in the integrated exhaust manifold.

13 Claims, 9 Drawing Sheets

INTEGRATED EXHAUST MANIFOLD

BACKGROUND/SUMMARY

Exhaust manifolds have been integrated into cylinder heads to increase the compactness of the engine and to increase exhaust manifold cooling. A cylinder head may be constructed from a single casting to reduce engine construction costs as well as to increase the compactness of the cylinder head. A cylinder head with an integrated exhaust manifold for providing increased cooling of the exhaust system is disclosed in US 2009/0126659. In particular, a two piece water jacket design is provided to increase the cooling of the exhaust manifold in the cylinder head.

However, the inventors herein have recognized various shortcomings with the exhaust manifold disclosed in US 2009/0126659. For example, the cross-sectional area of the engine's inner cylinder exhaust runners may increase losses within the exhaust manifold, thereby decreasing the amount of energy delivered to a turbine positioned downstream of the exhaust manifold. Consequently, the engine's efficiency can be reduced. Furthermore, the cross-sectional area of the engine's two outer cylinder exhaust runners may cause boundary layers within the exhaust manifold that limit exhaust flow from the two outer cylinders. Thus, the exhaust runners of the outer cylinders can further limit engine performance and fuel economy.

As such, various example systems and approaches are described herein. In one example, a cylinder head of an engine with an integrated exhaust manifold is provided. The cylinder head including a first exhaust runner for a cylinder positioned between two other cylinders, the first exhaust runner having a cross-sectional area less than a first area at a location between a first valve guide entry point and a first confluence area for mixing exhaust gases with a different cylinder. The cylinder head further including a second exhaust runner for a cylinder positioned at an end of a cylinder bank, the second exhaust runner having a cross-sectional area greater than the first area at a location between a second valve guide entry point and a second confluence area for mixing exhaust gases from a different cylinder.

By reducing the cross-sectional area of a first exhaust runner, exhaust gases can be concentrated to the center of the exhaust outlet of the exhaust manifold. As a result, impingement of exhaust gases on the exhaust outlet can be reduced to lower losses within the exhaust manifold. In this way, the energy within the exhaust gases provided to a turbine of a turbocharger positioned downstream of the exhaust manifold may be increased, thereby increasing the speed of the turbine.

Additionally, a cross-sectional area and lead-in angle of a second exhaust runner at the end of the cylinder head can be constructed to control boundary layers in the exhaust manifold. The lead-in angle defines an intersection between a line parallel to an outer edge of a straight portion of the second exhaust runner and a plane spanning an exhaust outlet. The impingement of the exhaust gases on the exhaust manifold walls may be reduced to control boundary layers in the exhaust manifold when the lead-in angle is within a particular range. As such, losses within the exhaust manifold may be further reduced.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
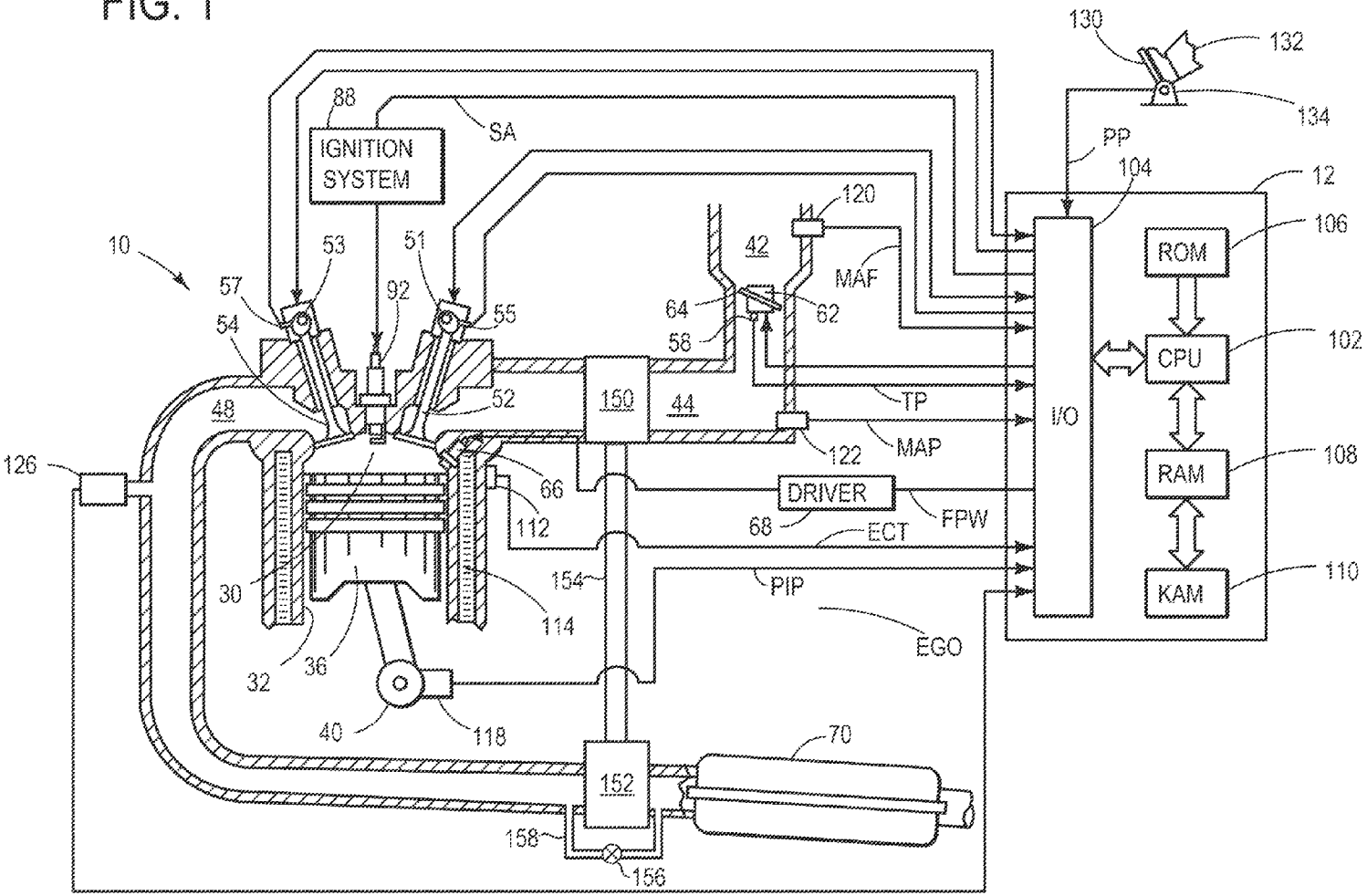
FIG. 1 shows a schematic depiction of an engine.

A cylinder head with an integrated exhaust manifold is disclosed herein. The integrated exhaust manifold has various geometric characteristics that are conducive to decreasing losses within the exhaust system as well as to improving turbocharger performance.

For example, the cylinder head may include a first exhaust runner for a cylinder positioned between two other cylinders, the first exhaust runner having a cross-sectional area less than a first area at a location between a first valve guide entry point and a first confluence area for mixing exhaust gases with a different cylinder. The cylinder head further including a second exhaust runner for a cylinder positioned at an end of a cylinder bank, the second exhaust runner having a cross-sectional area greater than the first area at a location between a second valve guide entry point and a second confluence area for mixing exhaust gases from a different cylinder.

In this way the cross-sectional area of the first exhaust runner may contract downstream of the first valve guide entry point. The contraction in the first exhaust runner decreases expansion losses and helps to maintain exhaust gas velocity within the exhaust manifold. For example, the contraction may direct exhaust gases at a central portion of a collector in the exhaust manifold downstream of the first and second exhaust runners, decreasing exhaust gas impingement on the walls of the collector and therefore decreasing losses within the exhaust manifold. Additionally, the contraction can decrease flow separation and therefore losses within the exhaust runner. Furthermore, the contraction in the first exhaust runner can also decrease cross-talk between cylinder exhaust valves. For example, the contractions can promote propagation of pressure waves generated via exhaust valve actuation downstream of the exhaust manifold.

Additionally the cross-sectional area of the second exhaust runner has a cross-sectional area which expands in a curved portion of the second exhaust runner and which contracts in a straight portion of the second exhaust runner. Further, the cross-sectional area of the second exhaust runner is greater than the first area of the first exhaust runner along the length of the second exhaust runner from the second valve guide entry point to a confluence area. It has been found that the expansion and subsequent contraction in the second exhaust runner further decreases losses within the exhaust manifold for outer cylinders having flow directed to a center exhaust manifold outlet.

Furthermore, the lead-in angle of the second exhaust runner may be between 14 and 17 degrees. The lead-in angle defines an intersection between a line parallel to an outer edge of a straight portion of the second exhaust runner and a plane spanning an exhaust outlet. When the lead-in angle is within this range the impingement of the exhaust gases on the manifold walls may be reduced, thereby further reducing losses in the exhaust manifold.

In this way, various performance characteristics of the engine may be improved such as the engine's efficiency, the low and high end torque produced by the engine, the time to torque (e.g., turbo-lag), etc., when the exhaust manifold includes one or more of the geometric characteristics described above.

Figure 2:
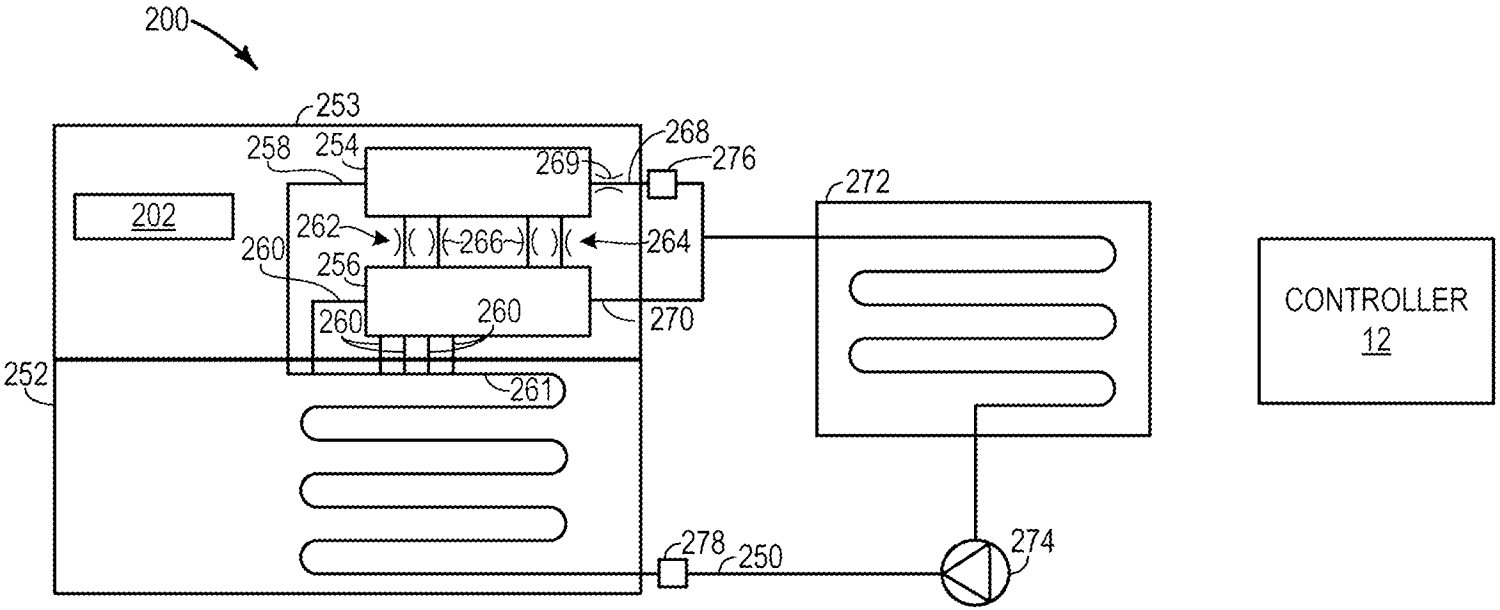
FIG. 2 shows a schematic depiction of an exhaust manifold and cooling system that may be included in the engine shown in FIG. 1.
Figure 3:
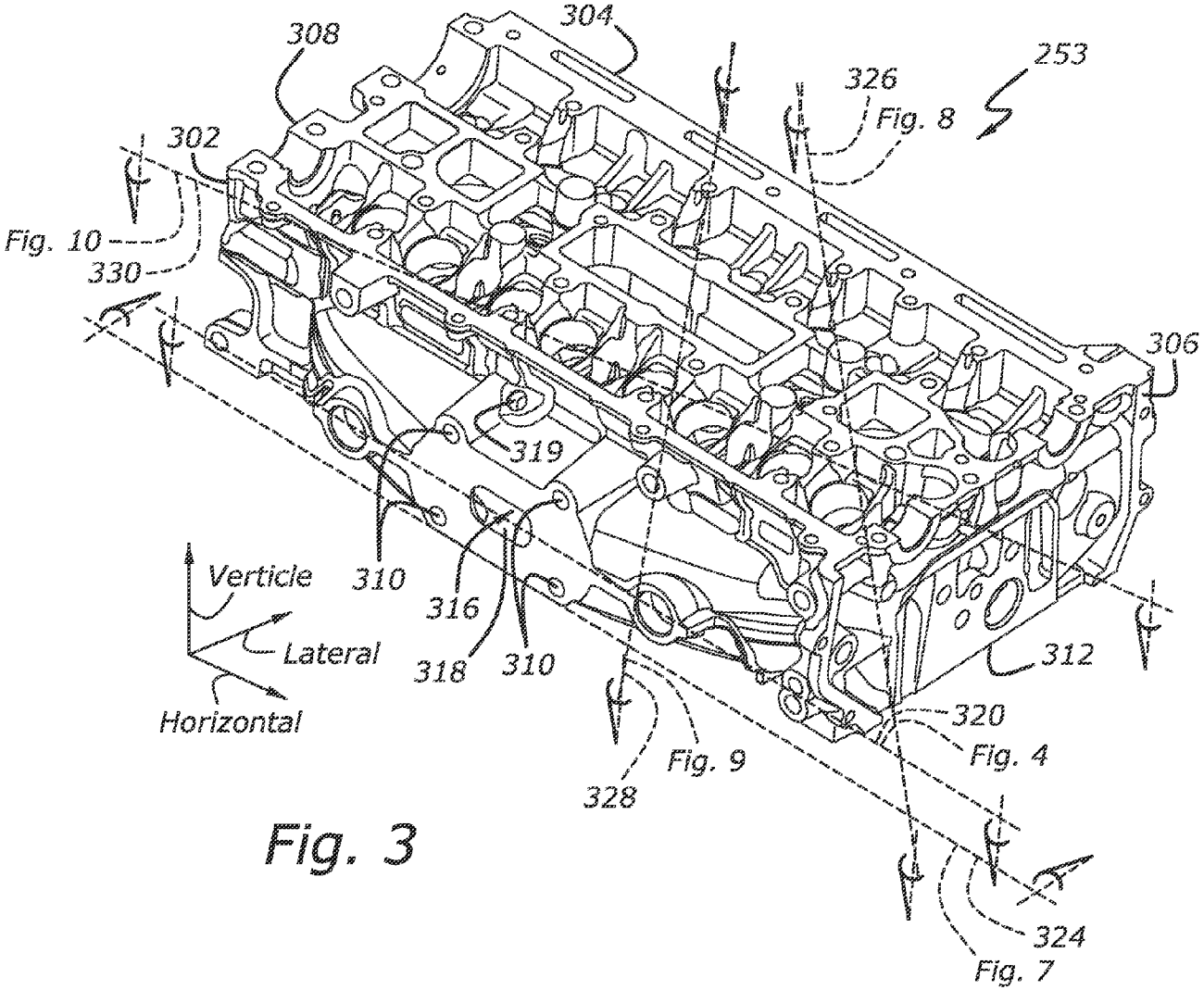
FIG. 3 shows an illustration of an example cylinder head drawn approximately to scale.
Figure 4:
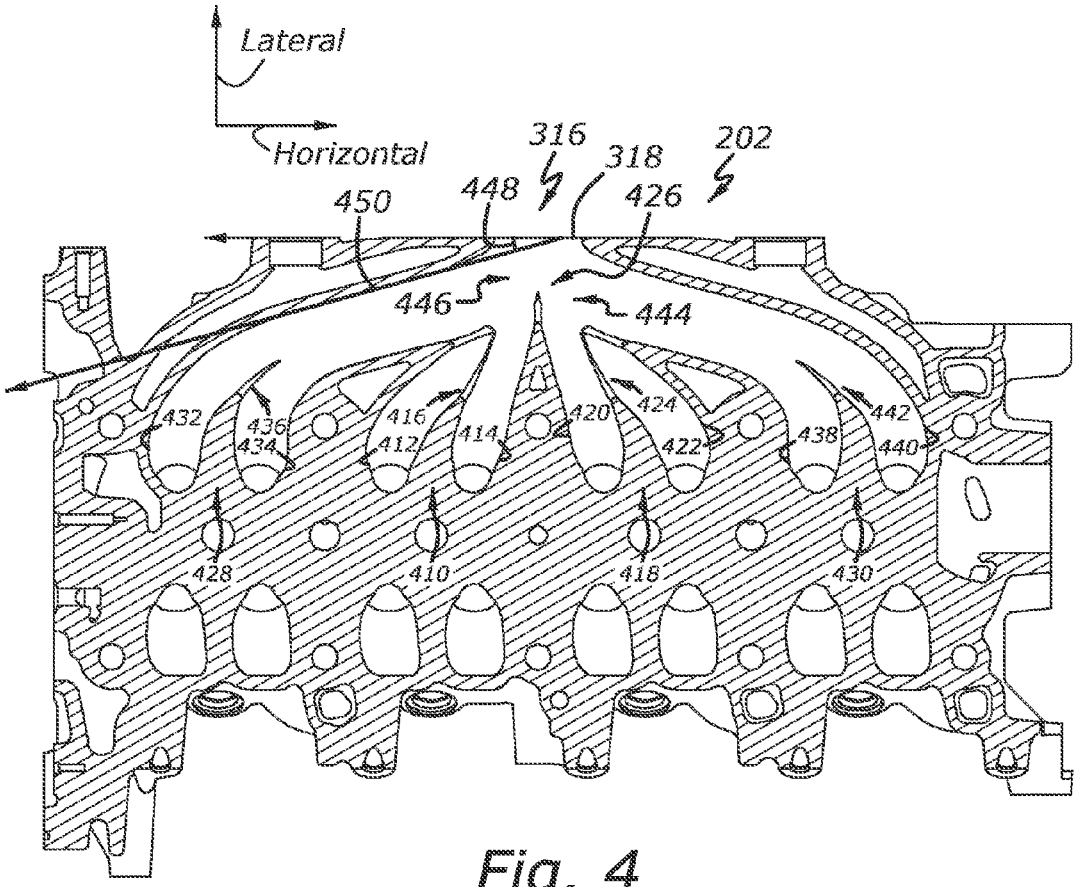
FIG. 4 shows a cross-sectional view of an exhaust manifold included in the cylinder head shown in FIG. 3, drawn approximately to scale.
Figure 5:
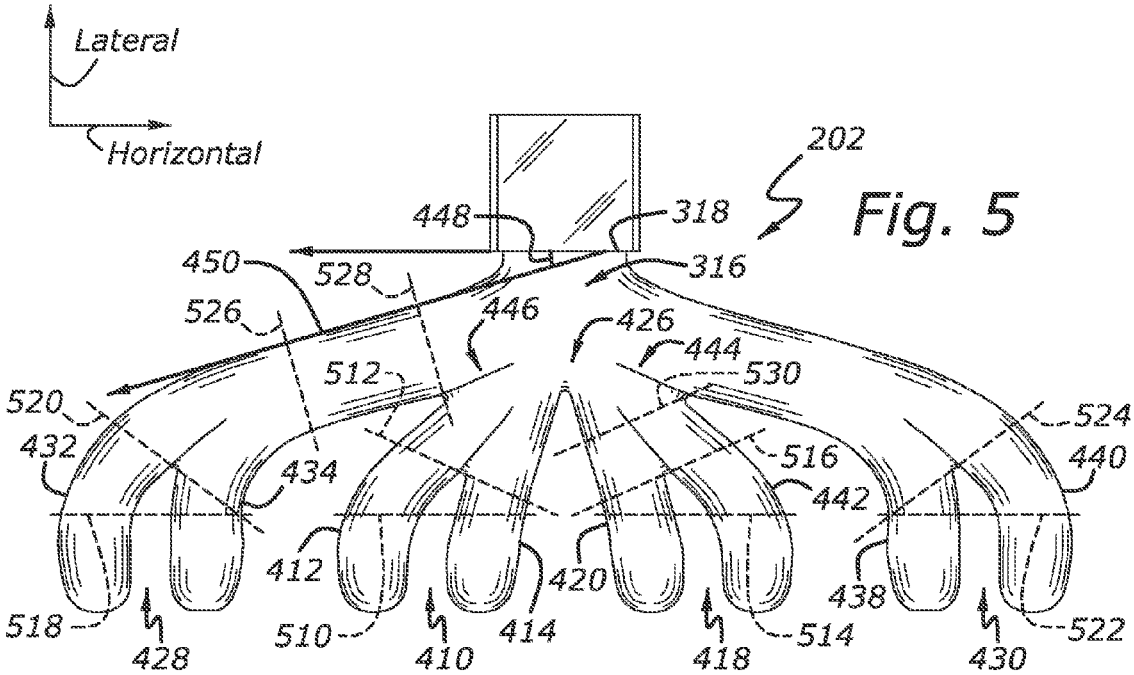
FIG. 5 shows a core print for casting the cylinder head shown in FIG. 3, drawn approximately to scale.
Figure 6:
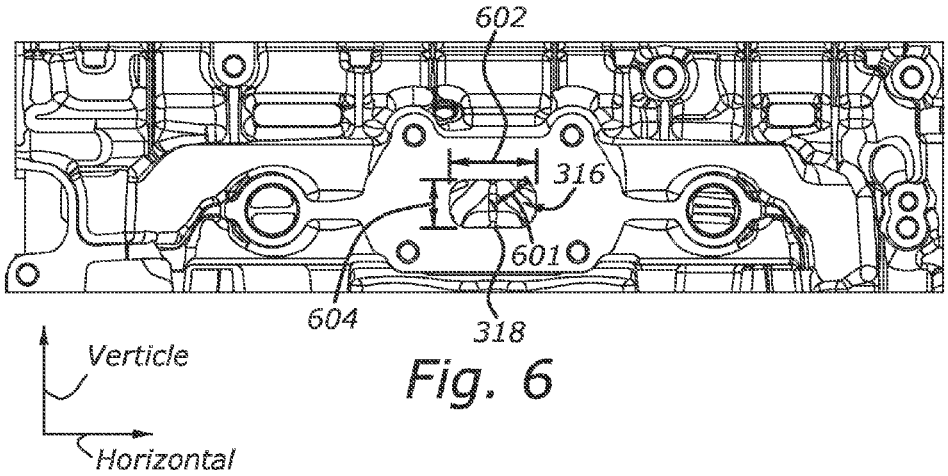
FIG. 6 shows a side view of the cylinder head shown in FIG. 3, drawn approximately to scale.

FIGS. 1 and 2 show schematic depictions of an engine and a corresponding exhaust manifold and cooling system. FIG. 3 shows a perspective view of a cylinder head including an integrated exhaust manifold, drawn approximately to scale. FIG. 4 shows a cross-section of the cylinder head shown in FIG. 3. FIG. 5 shows a manifold port core of the cylinder head shown in FIG. 3. FIG. 6 shows a side view of the cylinder head shown in FIG. 3. FIGS. 7-10 show various cross-sections of the cylinder head shown in FIG. 3. FIGS. 11-14 show various graphs depicting the quantitative improvements of an engine using the exhaust manifold shown in FIGS. 3-10 over other manifold designs.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Intake manifold 44 is also shown intermediate of intake valve 52 and air intake zip tube 42. Fuel is delivered to fuel injector 66 by a fuel system (not shown) including a fuel tank, fuel pump, and fuel rail (not shown). The engine 10 of FIG. 1 is configured such that the fuel is injected directly into the engine cylinder, which is known to those skilled in the art as direct injection. Fuel injector 66 is supplied operating current from driver 68 which responds to controller 12. In addition, intake manifold 44 is shown communicating with optional electronic throttle 62 with throttle plate 64. In one example, a low pressure direct injection system may be used, where fuel pressure can be raised to approximately 20-30 bar. Alternatively, a high pressure, dual stage, fuel system may be used to generate higher fuel pressures. Still in alternate embodiments a port injection system may be used.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Engine 10 further includes a turbocharger having a compressor 150 coupled to a turbine 152 via drive shaft 154. In this way, engine 10 may be a forced induction engine. The compressor is disposed in intake manifold 44 and the turbine is coupled to exhaust manifold 48. The compressor is configured to provide boost to engine 10, thereby increasing the engine's power output during selected operating conditions. A wastegate 156 may be disposed in a turbine bypass passage 158. The wastegate may be configured to alter the amount of exhaust gas bypassing the turbine. The wastegate may be adjusted via controller 12. In this way, the amount of boost provided to the engine may be selectively altered. However, in other embodiments the boost provided to the engine may be adjusted via alternate techniques such as adjusting a compressor bypass valve or adjusting the aspect ratio of a variable geometry turbine.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, Hall effect sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. However in other examples compression ignition may be utilized. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

FIG. 2 shows a schematic depiction of an engine including a cooling system 200 and an integrated exhaust manifold 202. It will be appreciated that exhaust manifold 202 may be similar to exhaust manifold 48 shown in FIG. 1. Cooling system 200 may be configured to remove heat from the cylinder head, thereby decreasing combustion temperatures and the thermal stresses on the cylinder head and integrated exhaust manifold.

It will be appreciated that the cooling system may be included in engine 10, shown in FIG. 1. Controller 12 may be configured to regulate the amount of heat removed from the engine via coolant circuit 250. In this way, the temperature of the engine may be regulated allowing the combustion efficiency to be increased as well as reducing thermal stress on the engine.

Cooling system 200 includes coolant circuit 250 which travels through a cylinder block 252. Water or another suitable coolant may be used as the working fluid in the coolant circuit. The cylinder block may include a portion of one or more combustion chambers. It will be appreciated that the coolant circuit may travel adjacent to the portions of the combustion chambers. In this way, excess heat generated during engine operation may be transferred to the coolant circuit.

A cylinder head 253 may be coupled to the cylinder block to form a cylinder assembly. When assembled, the cylinder assembly may include a plurality of combustion chambers. The cylinder head may include an upper cooling jacket 254 and a lower cooling jacket 256. However, in other embodiments a single cooling jacket may be provided. As shown, the upper cooling jacket includes an inlet 258 and the lower cooling jacket includes a plurality of inlets 260. However in other embodiments the lower cooling jacket may include a single inlet and the upper cooling jacket may include a plurality of inlets. Inlet 258 and inlets 260 are coupled to a common coolant circuit passage 261 in the cylinder block. In this way, the upper and lower cooling jackets receive coolant via their respective inlets from a common coolant source included in an engine block of the engine. However it will be appreciated that in some embodiments the upper and lower cooling jackets may receive coolant from different coolant passages in the engine block.

A first set of crossover coolant passages 262 may fluidly couple the upper cooling jacket to the lower cooling jacket. Likewise, a second set of crossover coolant passages 264 may additionally fluidly couple the upper cooling jacket to the lower cooling jacket.

Each crossover coolant passage included in the first set of crossover coolant passages may include a restriction 266. Various characteristics (e.g., size, shape, etc.) of the restrictions may be tuned during construction of cylinder head 253. Therefore, the restrictions included in the first set of crossover coolant passages may be different in size, shape, etc., than the restrictions included in the second set of crossover coolant passages and/or restriction 269. In this way, the cylinder head may be tuned for a variety of engines, thereby increasing the cylinder head's applicability. Although two crossover coolant passages are depicted in both the first and second sets of crossover coolant passages, the number of crossover coolant passages included in the first set and second sets of crossover coolant passages may be altered in other embodiments.

The crossover coolant passages allow coolant to travel between the cooling jackets at various points between the inlets and the outlets of both the upper and lower cooling jackets. In this way, the coolant may travel in a complex flow pattern where coolant moves between the upper and lower jackets, in the middle of the jacket and at various other locations within the jacket. The mixed flow pattern reduces the temperature variability within the cylinder head during engine operation as well as increases the amount of heat energy that may be removed from the cylinder head.

The upper cooling jacket includes an outlet 268. Outlet 268 may include a restriction 269. Additionally, the lower cooling jacket includes an outlet 270. It will be appreciated that in other embodiments outlet 270 may also include a restriction. The outlets from both the upper and lower cooling jackets may combine and be in fluidic communication. The coolant circuit may then travel through a radiator 272. The radiator enables heat to be transferred from the coolant circuit to the surrounding air. In this way, heat may be removed from the coolant circuit.

A pump 274 may also be included in the coolant circuit. A thermostat 276 may be positioned at the outlet 268 of the upper cooling jacket. A thermostat 278 may also be positioned at the inlet of the cylinder block. Additional thermostats may be positioned at other locations within the coolant circuit in other embodiments, such as at the inlet or outlet of the radiator, the inlet or outlet of the lower cooling jacket, the inlet of the upper cooling jacket, etc. The thermostats may be used to regulate the amount of fluid flowing through the coolant circuit based on the temperature. In some examples, the thermostats may be controlled via controller 12. However in other examples the thermostats may be passively operated.

It will be appreciated that controller 12 may regulate the amount of pressure head provided by pump 274 to adjust the flow-rate of the coolant through the circuit and therefore the amount of heat removed from the engine. Furthermore, in some examples controller 12 may be configured to dynamically adjust the amount of coolant flow through the upper cooling jacket via thermostat 276. Specifically, the flow-rate of the coolant through the upper cooling jacket may be decreased when the engine temperature is below a threshold value. In this way, the duration of engine warm-up during a cold start may be decreased, thereby increasing combustion efficiency and decreasing emissions.

FIG. 3 shows a perspective view of an example cylinder head 253. The cylinder head may be configured to attach to a cylinder block (not shown) which defines a plurality of cylinders having a piston reciprocally moving therein. The cylinders may be in an inline configuration in which the cylinders are aligned in a straight line with respect to the cylinder's central axis. The depicted cylinder head attaches to a cylinder block to form 4 cylinders. However, an alternate number of cylinders may be utilized in other embodiments, three cylinders for example. It will be appreciated that the collection of cylinders positioned in an inline configuration in the engine may be referred to as a cylinder bank. The cylinder head may be cast out of a suitable material such as aluminum. Other components of an assembled cylinder head have been omitted. The omitted components include a camshafts, camshaft covers, intake and exhaust valves, spark plugs, etc.

As shown, cylinder head 253 includes four perimeter walls. The walls include a first and a second side wall, 302 and 304 respectively. The four perimeter walls may further include a front end wall 306 and a rear end wall 308. The first side wall may include turbo mounting bolt bosses 310 or other suitable attachment apparatus that accepts an inlet to a turbocharger. In this way, the turbocharger may be mounted directly to the cylinder head reducing losses within the engine. However, it will be appreciated that the turbocharger may be in-directly coupled to the cylinder head. The turbocharger may include an exhaust driven turbine coupled to a compressor via a drive shaft, as previously discussed. A bottom wall 312 may be configured to couple to the cylinder head (not shown) thereby forming the engine combustion chambers, as previously discussed.

Cylinder head 253 may further include an exhaust manifold including an exhaust collector 316. The collector is positioned downstream of a valve guide entry point, shown in FIG. 4, and upstream of an exhaust outlet 318. As shown, the outlet is vertically and horizontally aligned. However other alignments are possible. The cylinder head may further include a boss (not shown) for positioning an oxygen sensor in the collector. The boss may provide access to the collector for sensing exhaust gases from all cylinders of the cylinder head. In one example, the boss may be positioned below a de-gas port 319 for the upper cooling jacket. However, the boss may be positioned in another suitable location in other examples.

The exhaust manifold further includes a plurality of exhaust runners coupled to the collector. The exhaust runners are illustrated and discussed in more detail with regard to FIGS. 4-10. Additionally the exhaust runners may be coupled to one or more exhaust valves via valve guides. Each exhaust runner is coupled to the exhaust valves for each cylinder. In this way, the exhaust manifold and exhaust runners may be integrated into the cylinder head. The integrated exhaust runners have a number of benefits, such as reducing the number of parts within the engine thereby reducing cost throughout the engine's development cycle. Furthermore, inventory and assembly cost may also be reduced when an integrated exhaust manifold is utilized. Cutting plane 320 defines the cross-section shown in FIG. 4. Cutting plane 324 defines the cross-section shown in FIG. 7 and cutting plane 326 defines the cross-section shown in FIG. 8. Cutting plane 328 defines the cross-section shown in FIG. 9 and cutting plane 330 defines the cross-section shown in FIG. 10.

FIG. 4 shows a cross-sectional view of exhaust manifold 202 included in the cylinder head 253 shown in FIG. 3. Collector 316, included in the exhaust manifold, is coupled to a first inner exhaust runner 410 for a cylinder positioned between two other cylinders. The first inner exhaust runner 410 includes a first entry conduit 412 and a second entry conduit 414 meeting at a confluence area 416. The first and second entry conduits include a first and a second valve guide entry point (710 and 712), shown in FIG. 7. It will be appreciated that the valve guide entry points may be configured to each receive a portion of an exhaust valve. Collector 316 is also coupled to a second inner exhaust runner 418. The second inner exhaust runner 418 includes a first entry conduit 420 and a second entry conduit 422 meeting at a confluence area 424. The first and second entry conduit include a first and second valve guide entry point (714 and 716), shown in FIG. 7. The exhaust runners receive exhaust gases from a cylinder during engine operation. The valve guide entry points allow exhaust valves to be positioned in the cylinder head such that the exhaust valves can limit gas flow from the cylinder to the runners. Therefore, each inner exhaust runner includes two entry conduits coupled to two exhaust valves. However, in other examples, the first and second inner exhaust runner may each include a single valve guide entry point. Therefore, in such an example, the first inner exhaust runner and the second inner exhaust runner each include a single entry conduit.

It will be appreciated that both of the inner exhaust runners may be coupled to cylinders positioned between two other cylinders. The first and second inner runners may converge at a confluence area 426 for mixing exhaust gases from the inner cylinders. As shown, the first and second inner exhaust runners may be directed in a substantially straight path to the exhaust outlet 318.

The exhaust manifold further includes a first outer exhaust runner 428 and a second outer exhaust runner 430 coupled to collector 316. The first and second outer exhaust runners are coupled to cylinders positioned at each the end of a cylinder bank. In other words, the first and second outer exhaust runners are coupled to the outermost cylinders in a cylinder bank with an inline configuration. The first outer exhaust runner includes a first entry conduit 432 and a second entry conduit 434 meeting at a confluence area 436. The first and second entry conduits (432 and 434) include a first valve guide entry port and a second valve guide entry port (718 and 720) shown in FIG. 7. Likewise, the second outer exhaust runner includes a first entry conduit 438 and a second entry conduit 440 meeting at a confluence area 442. The first and second entry conduits (438 and 440) include a first valve guide entry point and a second valve guide entry point (722 and 724) shown in FIG. 7.

The second outer exhaust runner 430 and the second inner exhaust runner 418 may converge at a confluence area 444 for mixing exhaust gases from the inner and outer cylinders. Likewise, the first outer exhaust runner 428 the first inner exhaust runner 410 may converge at a confluence area 446 for mixing exhaust gases from the inner and outer cylinders.

The first outer exhaust runner has a lead-in angle 448. Lead-in angle 448 may be defined as the intersection of a line parallel to a straight portion of outer-wall 450 of the first outer exhaust runner 428 and a plane spanning exhaust outlet 318. The outer-wall of the first outer exhaust runners may be a vertically aligned wall adjacent to side wall 302, shown in FIG. 3. Due to the symmetry of the exhaust manifold, it will be appreciated that the second outer exhaust runner has an identical lead-in angle.

It has been found unexpectedly that when the outer exhaust runners have a lead-in angle between 15 and 17 degrees flow separation in the exhaust gases during engine operation may be reduced, thereby reducing losses in the exhaust manifold. Specifically, a lead-in angle of 15.5 degrees may be utilized to decrease flow separation in the exhaust manifold. A lead-in angle within this range may also reduce impingement of the exhaust gases on the exhaust manifold walls. Furthermore, a lead-in angle within this range may also reduce the amount of cross-talk between the exhaust valves. For example, reaction waves generated during exhaust valve operation in the outer exhaust runners may be propagated downstream of the exhaust manifold as opposed to in the other exhaust runners. Therefore, exhaust valves having a lead-in angle between 15 and 17 degrees are utilized. In this way, engine operation may be improved via the reduction of cross-talk between the exhaust valves.

FIG. 5 shows the exhaust manifold port core of the exhaust manifold shown in FIG. 4. Although a core print is shown, it will be appreciated that exhaust gases may travel through the passages defined by the exhaust manifold port core. Therefore, corresponding parts are labeled accordingly.

Line 518 indicates a cutting plane of a location of the beginning of a region of the exhaust manifold port core of a first outer runner 428 where the cross-sectional area of first outer runner 428 is measured from. Line 520 indicates a cutting plane of an example location on the curved portion of first outer runner 428 where the cross-sectional area of the curved portion of first outer runner 428 can be measured. Lines 526 and 528 indicate cutting planes of example locations on the straight portion of first outer runner 428 where the cross-sectional area of the straight portion of first outer runner 428 can be measured. At line 518, first outer runner 428 has a first cross-sectional area. At line 520, first outer runner 428 has a second cross-sectional area. At lines 526 and 528, first outer runner 428 has a third cross-sectional area. The first outer runner 428 expands from the first cross-sectional area to the second cross-sectional area and contracts from the second cross-sectional area to the third cross-sectional area. Similarly, line 522 of the second outer exhaust runner 430 indicates a cutting plane of a location of the beginning of a region of the exhaust manifold port core where the cross-sectional of the runner is measured from. Line 524 indicates a cutting plane of an example location on the curved portion of the second outer runner 430 where the cross-sectional area of the curved portion of second outer runner 430 can be measured.

Line 510 indicates a cutting plane of an example location of the beginning of a region of the exhaust manifold port core of a first inner runner 410 where the cross-sectional area of inner runner 410 is measured from. Line 512 indicates a cutting plane of an example location of first inner runner 410 where the cross-sectional area of inner runner 410 is measured. At line 510, first inner runner 410 has a first cross-sectional area. At line 512, first inner runner 410 has a second cross-sectional area. The first cross-sectional area is greater than the second cross-sectional area. Similarly, line 514 indicates a cutting plane of an example location of the beginning of a region of the exhaust manifold port core of second inner runner 418 where the cross-sectional area of inner runner 418 is measured from. Line 516 indicates a cutting plane of an example location of second inner runner 418 where the cross-sectional area of inner runner 418 is measured. Line 530 indicates a cutting plane of another example location of second inner runner 418 where the cross-sectional area of the second inner runner 418 is measured.

FIG. 6 shows a side view of exhaust outlet 318. The cross-sectional area of the outlet may be 945 $mm^2$. Radius 601 of the outlet may be substantially 8 mm. The width 602 of the outlet may be substantially 43 mm. The height 604 of the outlet of the collector may be substantially 24 mm. Therefore, the width of the outlet is greater than the height of the outlet. In some embodiments the ratio between the width and the height of the exhaust outlet may be substantially 1.5 to 2. It will be appreciated that when the ratio of the width to height of the outlet is within the aforementioned range, impingement of the exhaust gases within the exhaust manifold may be reduced. In this way, losses within the exhaust manifold may be reduced, thereby increasing amount of energy provided to the turbine.

Figure 7:
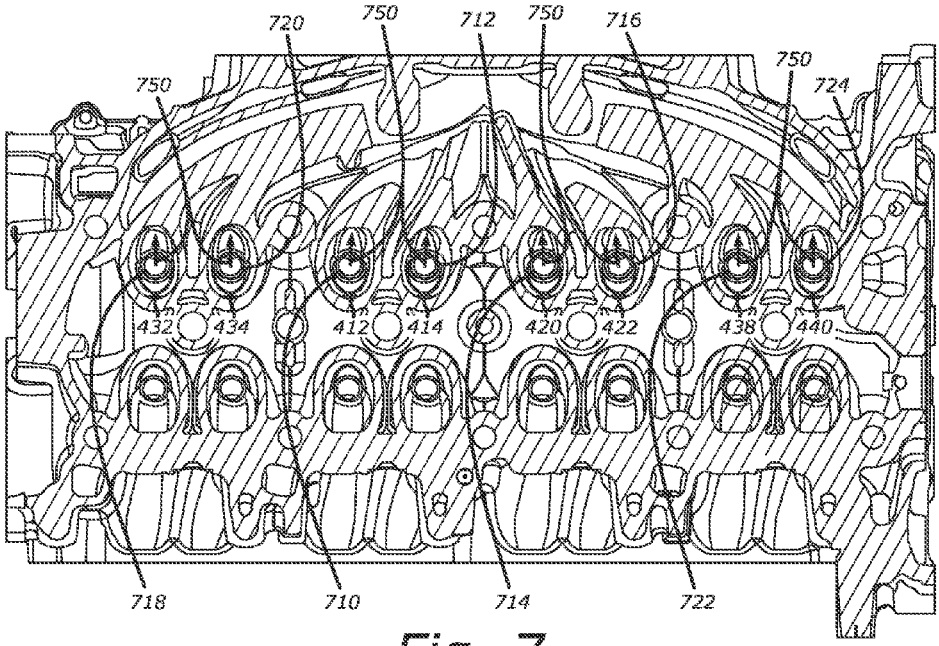
FIG. 7 shows a cross-sectional view of the valve guide entry points included in the exhaust manifold shown in FIG. 4, draw approximately to scale.

FIG. 7 shows a cross-sectional view of the first valve guide entry point 710 and the second valve guide entry point 712 and corresponding entry conduits (412 and 414) for the first inner exhaust runner 410. Additionally, FIG. 7 shows the first valve guide entry point 714 and the second valve guide entry point 716 and corresponding entry conduits (420 and 422) for the second inner exhaust runner 418. FIG. 7 further shows the first valve guide entry point 718 and the second valve guide entry point 720 and corresponding entry conduits (432 and 434) for the first outer exhaust runner 428. FIG. 7 also shows the first valve guide entry point 722 and the second valve guide entry point 724 and corresponding entry conduits (438 and 440) for the second outer exhaust runner 430. The cross-sectional area of the first inner exhaust runner between each of the two valve guide entry points (710 and 712) may be substantially 716 $mm^2$. For reference, the leading boundary, line 510, and the trailing boundary, line 512, of the sections of the first inner exhaust runner 410 are shown in FIG. 5. It will be appreciated that the cross-sectional area is measured via a plane spanning the exhaust runner and perpendicular to a line 750 tangent to the central axis of the exhaust runner. Likewise, the cross-sectional area of the second inner exhaust runner 418 between each of the two valve guide entry points (714 and 716) may be substantially 716 $mm^2$. For reference, the leading boundary, line 514, and the trailing boundary, line 516, of the sections of the second inner exhaust runner 418 are shown in FIG. 5. The cross-sectional area of the first outer exhaust runner between each of the two valve guide entry points (718 and 720) may be substantially 716 $mm^2$. For reference, the leading boundary, line 518, has a cross-sectional area that may be substantially 716 $mm^2$ are shown in FIG. 6. Likewise, the cross-sectional area of the second outer exhaust runner 430 between each of the two valve guide entry points (722 and 724) may be substantially 716 $mm^2$. For reference, the leading boundary, line 522, has a cross-sectional area that may be substantially 716 $mm^2$ are shown in FIG. 6.

Figure 8:
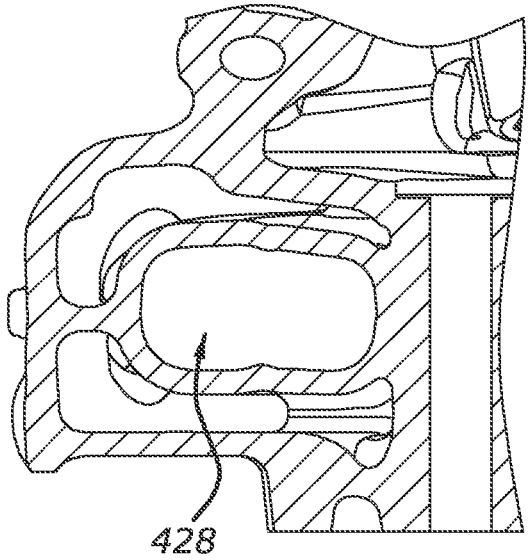
FIG. 8 shows a cross-sectional view of an outer exhaust runner included in the exhaust manifold shown in FIG. 4, draw approximately to scale.

FIG. 8 shows a cross-sectional view of the first outer exhaust runner 428 in a curved portion of the exhaust runner downstream of the valve guide entry points (718 and 720) and upstream of confluence area 446 in the direction of exhaust flow from the cylinder, shown in FIG. 4. As previously discussed, the cross-sectional area of the first outer exhaust runner begins at a first area and expands as the exhaust runner curves and contracts as the exhaust runner reaches a confluence point where exhaust gases from one cylinder mix with exhaust gases of another cylinder. The first outer exhaust runner 428 starts at the first area of substantially 716 $mm^2$ at a location downstream of the valve guide entry points (718 and 720) in a direction of exhaust flow.

The cross-sectional area of the first outer exhaust runner in the curved portion of the exhaust runner shown in FIG. 8 may be 716 $mm^2$. For reference, the leading boundary, line 520, and trailing boundary, line 526, of the curved portion of the first outer exhaust runner is shown in FIG. 5. As previously discussed the cross-sectional area may be measured via a plane spanning the exhaust runner and perpendicular to a line tangent to the central axis of the exhaust runner. Due to the symmetry within the exhaust manifold the second outer exhaust runner is similar in geometry and size to the first outer exhaust runner.

Figure 9:
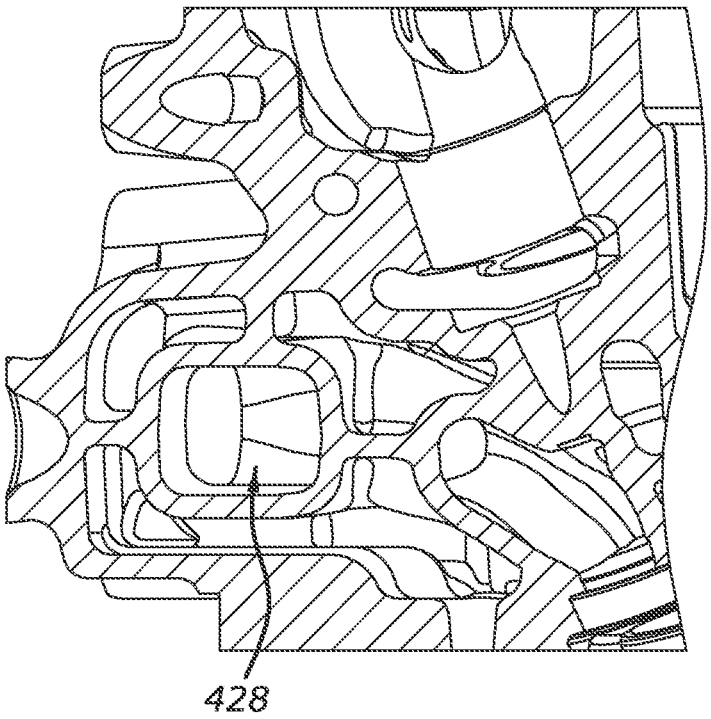
FIG. 9 shows another cross-sectional view of the outer exhaust runner included in the exhaust manifold shown in FIG. 4, draw approximately to scale.

FIG. 9 shows a cross-sectional view of the first outer exhaust runner 428 in a straight portion of the exhaust runner downstream of the valve guide entry points (718 and 720) in the direction of exhaust flow and upstream of confluence area 446. For reference, the leading boundary, line 526, and trailing boundary, line 528, of the straight portion of the first outer exhaust runner is shown in FIG. 5.

The cross-sectional area of the straight portion of the first outer exhaust runner may be less than the cross-sectional area of the curved portion of the first outer exhaust runner. Therefore, the cross-sectional area along the length of the first outer exhaust runner contracts in a straight portion of the runner. In particular the cross-sectional area of the straight portion of the exhaust runner shown may be 651 $mm^2$. Due to the symmetry within the exhaust manifold, the second outer exhaust runner is similar in geometry and size to the first outer exhaust runner. Therefore, the second outer exhaust runner may also experience an expansion and downstream contraction.

It has been unexpectedly found that the expansion and subsequent contraction in the first and second outer exhaust runners may reduce flow separation of the exhaust gases within the outer exhaust runners, thereby decreasing losses within the exhaust manifold. When losses within the exhaust manifold are reduced the energy delivered to the turbine of the turbocharger positioned downstream of the exhaust manifold is increased thereby increasing the engine's efficiency and potential power output.

Figure 10:
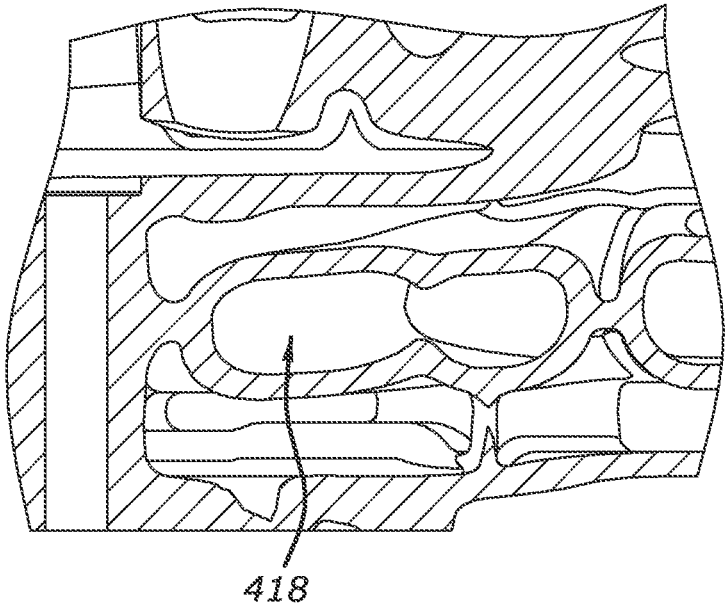
FIG. 10 shows a cross-sectional view of an inner exhaust runner included in the exhaust manifold shown in FIG. 4, draw approximately to scale.

FIG. 10 shows a cross-sectional view of the second inner exhaust runner 418 in a portion of the exhaust runner downstream of the valve guide entry points (714 and 716) in the direction of exhaust flow and upstream of confluence area 444. The cross-sectional area of this portion may be less than the cross-sectional area of the exhaust runner downstream of the valve guide entry points in the direction of exhaust flow. Specifically, the cross-sectional area may be 660 $mm^2$. For reference the leading boundary, line 516, and trailing boundary, line 530, of the portion of the second inner exhaust runner discussed above is shown in FIG. 5. In this way, the cross-sectional area of the second inner exhaust runner along the length of the runner contracts. Due to the symmetry of the exhaust manifold it will be appreciated that the first inner exhaust runner is similar in geometry and size to the second inner exhaust runner.

The contraction in the first and second inner exhaust runners concentrates the exhaust gases in the center of the exhaust outlet 318, decreasing impingement of exhaust gases on the walls of the outlet 318. As such, the exhaust manifold losses can be decreased. Therefore, the energy delivered to the turbine via the exhaust gases may be increased when compared to other exhaust manifolds that do not have a contraction. In this way, the efficiency of the turbocharger and therefore the engine may be increased.

Thus, the cylinder head of FIGS. 3-11, provides for a cylinder head including a first exhaust runner for a cylinder positioned between two other cylinders, the first exhaust runner having a cross-sectional area less than a first area at a location between a first valve guide entry point and a first confluence area for mixing exhaust gases with a different cylinder. The cylinder head further including a second exhaust runner for a cylinder positioned at an end of a cylinder bank, the second exhaust runner having a cross-sectional area greater than the first area at a location between a second valve guide entry point and a second confluence area for mixing exhaust gases from a different cylinder. The cylinder head also includes where cross-sectional area of the first exhaust runner contracts between the first valve guide entry point and the first confluence area, and where the cross-sectional area of the first exhaust runner is less than the first area along the length of the first exhaust runner from the first valve guide entry point to the first confluence area.

The cylinder head also includes where cross-sectional area of the second exhaust runner has a cross-sectional area which expands in a curved portion of the second exhaust runner and which contracts in a straight portion of the second exhaust runner, and where the cross-sectional area of the second exhaust runner is greater than the first area along the length of the second exhaust runner from the second valve guide entry point to the second confluence area. The cylinder head also includes where the curved portion of the second exhaust runner and the straight portion of the second exhaust runner is between the second valve guide entry point and the second confluence area. The cylinder head also includes an exhaust outlet that accepts an inlet to a turbocharger. The cylinder head also includes a lead-in angle of the second exhaust runner to the first exhaust runner is between 14 and 17 degrees. The cylinder head also includes where the lead-in angle defines an intersection between a line parallel to an outer edge of a straight portion of the second exhaust runner and a plane spanning an exhaust outlet.

Additionally the cylinder head of FIGS. 3-10 provides for a cylinder head including first and second inner exhaust runners, a cross-sectional area of the first inner exhaust runner less than a first area, the cross-sectional area of the first inner exhaust runner at a location downstream of a first valve guide entry point and upstream of a first confluence area, a cross-sectional area of the second inner exhaust runner at a location downstream of a second valve guide entry point and upstream of a second confluence area. The cylinder head further includes first and second outer exhaust runners, a cross-sectional area of the first outer exhaust runner greater than the first area, the cross-sectional area of the first outer exhaust runner at a location downstream of a third valve guide entry point and upstream of the first confluence area, a cross-sectional area of the second outer exhaust runner at a location downstream of a fourth valve guide entry point and upstream of the second confluence area.

The cylinder head also includes where the first inner exhaust runner has a cross-sectional area which contracts between the first valve guide entry point and the first confluence area. The cylinder head also includes where the first outer exhaust runner has a cross-sectional area which expands in a curved portion of the first outer exhaust runner and which contracts at a straight portion of the first outer exhaust runner. The cylinder head also includes where the curved portion of the first outer exhaust runner and the straight portion of the first outer exhaust runner is between the third valve guide entry point and the first confluence area. The cylinder head also includes an exhaust outlet that accepts an inlet to a turbocharger. The cylinder head also includes where a lead-in angle of the first outer exhaust runner to the first inner exhaust runner is between 14 and 17 degrees. The cylinder head also includes where the lead-in angle defines an intersection between a line tangent to an outer edge of a straight portion of the first outer exhaust runner and a plane spanning an outlet of a collector.

Additionally the cylinder head of FIGS. 3-10 provide for a cylinder head including first and second inner exhaust runners, a cross-sectional area of the first inner exhaust runner less than a first area, the cross-sectional area of the first inner exhaust runner at a location downstream of a first valve guide entry point and upstream of a first confluence area, a cross-sectional area of the second inner exhaust runner at a location downstream of a second valve guide entry point and upstream of a second confluence area. The cylinder head further including first and second outer exhaust runners, a cross-sectional area of the first outer exhaust runner greater than the first area, the cross-sectional area of the first outer exhaust runner at a location downstream of a third valve guide entry point and upstream of the first confluence area, a cross-sectional area of the second outer exhaust runner at a location downstream of a fourth valve guide entry point and upstream of the second confluence area. The cylinder head further includes an exhaust outlet for the first and second inner exhaust runners as well as for the first and second outer exhaust runners, the exhaust outlet having a height that is less than a width of the exhaust outlet.

The cylinder head also includes where the exhaust outlet has a height to width ratio of substantially 1.5 to 2. The cylinder head also includes where the first and second inner exhaust runners are directed in a substantially straight path to the exhaust outlet. The cylinder head also includes where exhaust outlet has at least one radius of at least 8 mm. The cylinder head also includes a boss for an oxygen sensor positioned in a collector, the collector positioned downstream of the first valve guide entry point and upstream of the exhaust outlet. The cylinder head also includes where the exhaust outlet is directly or in-directly coupled to an inlet of a turbocharger. The cylinder head also includes a boss for an oxygen sensor positioned in a collector, the collector positioned downstream of the first valve guide entry point and upstream of the exhaust outlet. The cylinder head also includes where the exhaust outlet is coupled to an inlet of a turbocharger.

Figure 11:
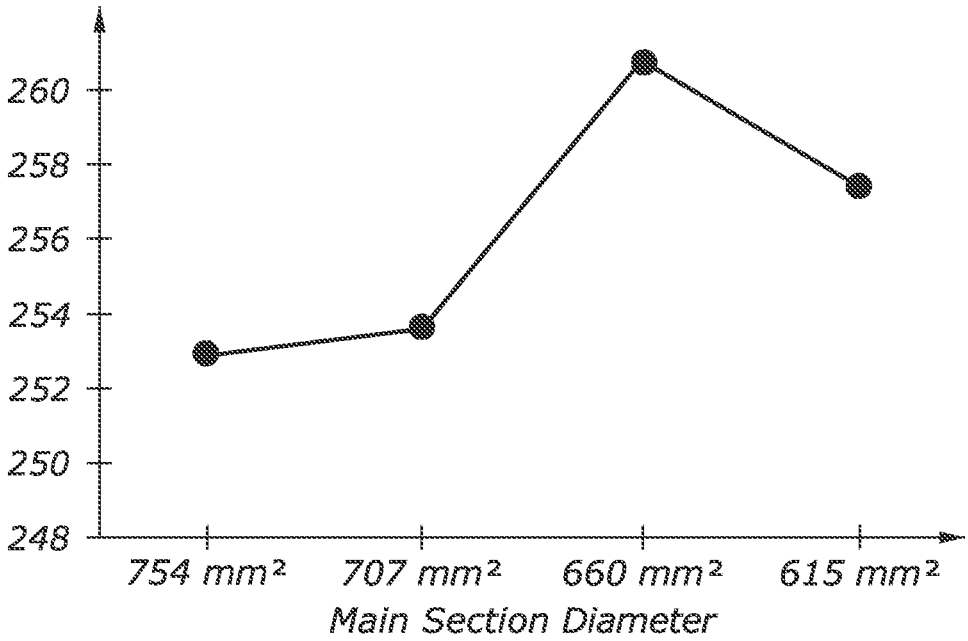
FIGS. 11-14 show various graph depicting the quantitative improvements of the exhaust manifold depicted in FIG. 4.

FIG. 11 shows a graph depicting the engine's power output vs. the cross-sectional area of a portion of the first and second inner exhaust runners downstream of the valve guide entry point and upstream of a confluence area. The graph was generated using an integrated 1D/3D computational fluid dynamics program modeling the flow characteristics of an exhaust manifold having similar geometric characteristics to the exhaust manifold shown in FIGS. 4-10. As shown, the cross-sectional area of a portion of the inner exhaust runners downstream of the valve guide entry points and upstream of a confluence area was varied to determine an optimal cross-sectional area. It will be appreciated that wall temperatures of the exhaust manifold were taken into account when modeling the exhaust manifold to study the heat transfer coefficient as well as the heat flux effects on engine performance. Furthermore, the area of the outlet of the collector was held constant. As shown, the power output is maximized when the cross-sectional area of the each of the inner exhaust runners is 29 $mm^2$. It will be appreciated that the combined cross-sectional area of two of the valve guide entry points in the exhaust manifold utilized in the model was approximately 30.2 $mm^2$. Therefore, the exhaust gases traveling through the inner runner experience a contraction which concentrates the exhaust gases in the middle of the collector as well as decreased flow separation within the inner exhaust runner, decreasing losses in the exhaust manifold.

Figure 12:
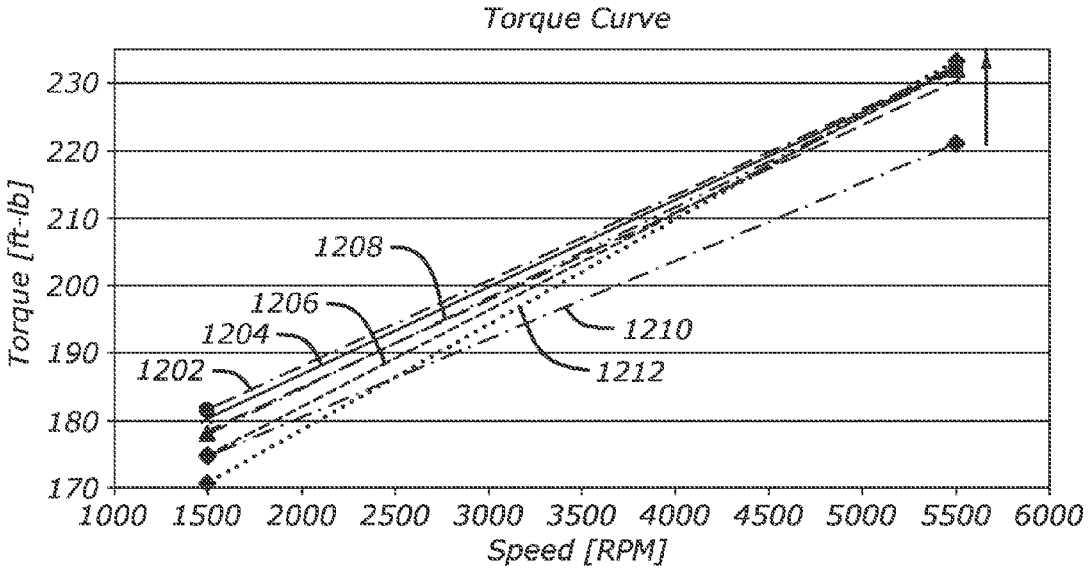

FIG. 12 shows a torque curve for the exhaust manifold using a computational fluid dynamics computer modeling program for a number of exhaust manifold designs. Line 1202 represents the torque curve for a 2 liter inline 4 cylinder engine utilizing the integrated exhaust manifold where the cross-sectional area of a portion of the first and second inner exhaust runners downstream of the valve guide entry point and upstream of a confluence area is 660 $mm^2$. Line 1204 represents a torque curve for a 2 liter inline 4 cylinder engine utilizing an integrated exhaust manifold where the cross-sectional area of a portion of the first and second inner exhaust runners downstream of the valve guide entry point and upstream of a confluence area is 706 $mm^2$. Line 1206 represents a torque curve for a 2 liter inline 4 cylinder engine utilizing an integrated exhaust manifold where the cross-sectional area of the inner exhaust runners is 750 $mm^2$. Line 1208 represents a torque curve for a 2 liter inline 4 cylinder engine utilizing an integrated exhaust manifold where the cross-sectional area of a portion of the first and second inner exhaust runners downstream of the valve guide entry point and upstream of a confluence area is 750 $mm^2$. Line 1210 represents a torque curve for a 2 liter inline 4 cylinder engine utilizing an exhaust manifold where the cross-sectional area of a portion of the first and second inner exhaust runners downstream of the valve guide entry point and upstream of a confluence area is 600 $mm^2$. Line 1212 represents a torque curve for a 2 liter inline 4 cylinder engine utilizing an integrated exhaust manifold where the cross-sectional area of a portion of the first and second inner exhaust runners downstream of the valve guide entry point and upstream of a confluence area is 803 $mm^2$. As shown the area under the torque curve for the exhaust manifold having a 660 $mm^2$ cross-sectional area of the inner exhaust runners is increased. In particular the low end torque for the 660 $mm^2$ exhaust manifold is greater than the other manifold designs.

Figure 13:
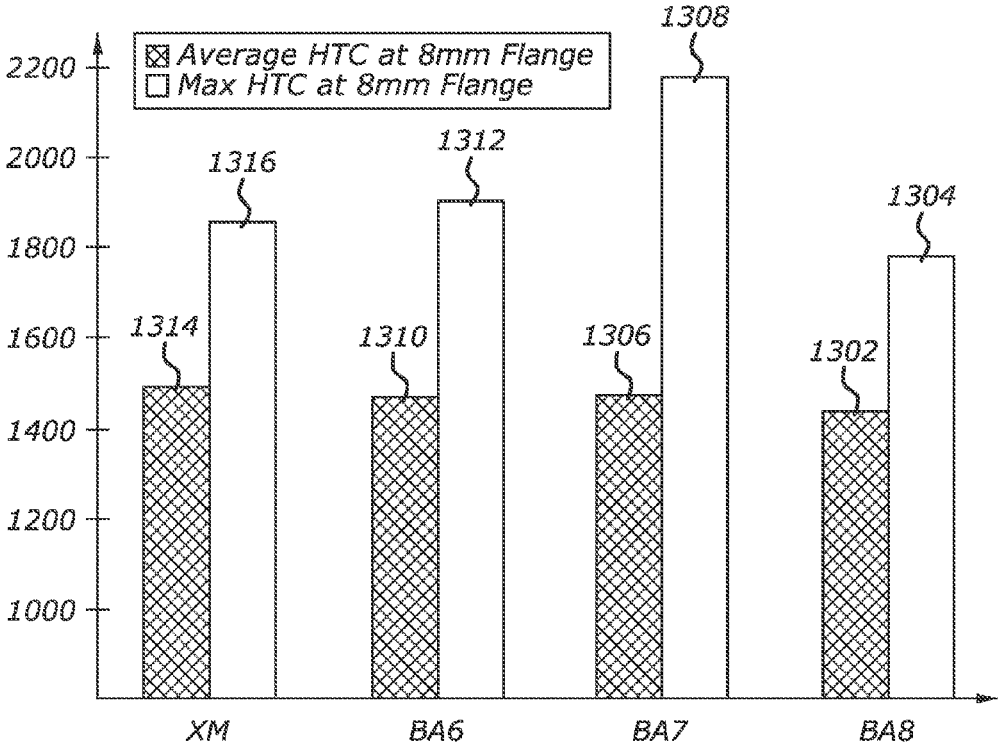

FIG. 13 shows a bar graph of the heat transfer coefficient (HTC) at the outlet of a collector for a variety of exhaust manifold designs. The bars with cross-hatching represent the average HTC at the outlet of the collector and the bars without cross-hatching represent the average HTC at the outlet of the collector. Bars 1302 and 1304 represent the average and maximum HTC at the outlet of a collector of an exhaust manifold having a 660 $mm^2$ inner-runner cross-sectional area. Bars 1306 and 1308 represent the average and maximum HTC at the outlet of a collector of an exhaust manifold having a 706 $mm^2$ inner-runner cross-sectional area. Bars 1310 and 1312 represent the average and maximum HTC at the outlet of a collector of an exhaust manifold having a 804 $mm^2$ inner-runner cross-sectional area. Bars 1314 and 1316 represent the average and maximum HTC at the outlet of a collector of an exhaust manifold having a 820 $mm^2$ inner-runner cross-sectional area. As shown both the average and maximum HTC of the exhaust manifold having inner-runners with a cross-sectional area of 660 $mm^2$ may be less than the other exhaust manifold geometries. In this way thermal stresses on the exhaust manifold may be reduced while increasing the exhaust manifold's efficiency when a 660 $mm^2$ inner-runner cross-sectional area is utilized.

Figure 14:
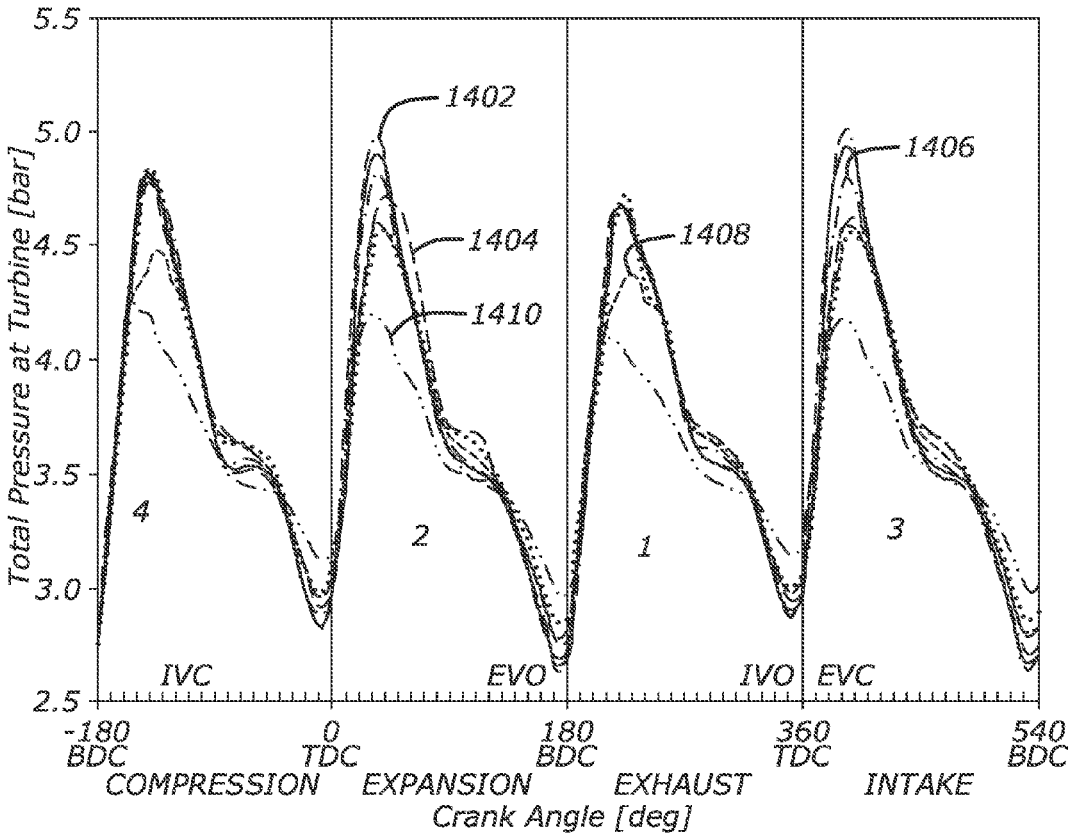

FIG. 14 shows a graph depicting the pressure at the turbine downstream of the exhaust manifold in an engine vs. the crank position. Line 1402 represents the pressure vs. crank position of an exhaust manifold having a 660 $mm^2$ cross-sectional area of the middle sections of the inner-runners. Line 1404 represents the pressure vs. crank position of an exhaust manifold having a 706 $mm^2$ cross-sectional area of the middle sections of the inner-runners. Line 1406 represents the pressure vs. crank position of an exhaust manifold having a 754 $mm^2$ cross-sectional area of the middle sections of the inner-runners. Line 1408 represents the pressure vs. crank position of an exhaust manifold having a 804 $mm^2$ cross-sectional area of the middle sections of the inner-runners. Line 1410 represents the pressure vs. crank position of an exhaust manifold having a 600 $mm^2$ cross-sectional area of the middle sections of the inner-runners. As shown the peaks in the pressure at the turbine for the engine having a 29.0 $mm^2$ cross-sectional area is greater than the peaks in pressure for the other exhaust manifold configurations. In this way, losses are reduced in an exhaust manifold having a contraction in the inner exhaust runners, thereby increasing the pressure of the gases delivered to the turbine coupled downstream of the exhaust manifold.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

The invention claimed is:

1. A cylinder head of an engine with an integrated exhaust manifold comprising:

a first inner exhaust runner including first and second conduits each having a valve guide entry point and a second inner exhaust runner including first and second conduits each having a valve guide entry point, a cross-sectional area of the first inner exhaust runner having a first area, the cross-sectional area of the first inner exhaust runner located downstream of the valve guide entry points of the first inner exhaust runner's first and second conduits and upstream of a first confluence area, a cross-sectional area of the second inner exhaust runner located downstream of the valve guide entry points of the second inner exhaust runner's first and second conduits and upstream of a second confluence area, the first and second confluence areas upstream of a third confluence area; and a first outer exhaust runner including first and second conduits each having a valve guide entry point and a second outer exhaust runner including first and second conduits each having a valve guide entry point, a cross-sectional area of the first outer exhaust runner greater than the first area, the cross-sectional area of the first outer exhaust runner located downstream of the valve guide entry points of the first outer exhaust runner's first and second conduits and upstream of a fourth confluence area, a cross-sectional area of the second outer exhaust runner located downstream of the valve guide entry points of the second outer exhaust runner's first and second conduits and upstream of the fourth confluence area, the fourth confluence area downstream of the third confluence area, and where the first, second, third, and fourth confluence areas are located within the cylinder head.

2. The cylinder head of claim 1, where the first inner exhaust runner has a cross-sectional area which contracts between the first valve guide entry point and the first confluence area.

3. The cylinder head of claim 1, where the first outer exhaust runner has a cross-sectional area which expands in a curved portion of the first outer exhaust runner and which contracts at a straight portion of the first outer exhaust runner.

4. The cylinder head of claim 3, where the curved portion of the first outer exhaust runner and the straight portion of the first outer exhaust runner is between the valve guide entry points of the first outer exhaust runner's first and second conduits and the fourth confluence area.

5. The cylinder head of claim 1, further comprising an exhaust outlet that accepts an inlet to a turbocharger.

6. The cylinder head of claim 1, wherein a lead-in angle of the first outer exhaust runner to the first inner exhaust runner is between 14 and 17 degrees.

7. The cylinder head of claim 6, wherein an outer wall of the first outer exhaust runner is separated from an external wall of the cylinder head via a single void.

8. A cylinder head of an engine with an integrated exhaust manifold comprising:

a first inner exhaust runner including first and second conduits each having a valve guide entry point and a second inner exhaust runner including first and second conduits each having a valve guide entry point, a cross-sectional area of the first inner exhaust runner having a first area, the cross-sectional area of the first inner exhaust runner located downstream of the valve guide entry points of point and upstream of a first confluence area, a cross-sectional area of the second inner the first inner exhaust runner's first and second conduits exhaust runner located downstream of the valve guide entry points of the second inner exhaust runner's first and second conduits and upstream of a second confluence area, the first and second confluence areas upstream of a third confluence area; and a first outer exhaust runner including first and second conduits each having a valve guide entry point and a second outer exhaust runner including first and second conduits each having a valve guide entry point, a cross-sectional area of the first outer exhaust runner greater than the first area, the cross-sectional area of the first outer exhaust runner located downstream of the valve guide entry points of the first outer exhaust runner's first and second conduits and upstream of a fourth confluence area, a cross-sectional area of the second outer exhaust runner located downstream of the valve guide entry points of the second outer exhaust runner's first and second conduits and upstream of the fourth confluence area, the fourth confluence area downstream of the third confluence area, and where the first, second, third, and fourth confluence areas are located within the cylinder head; and an exhaust outlet at a side of the cylinder head for the first and second inner exhaust runners as well as for the first and second outer exhaust runners, the exhaust outlet having a height that is less than a width of the exhaust outlet.

9. The cylinder head of claim 8, where the exhaust outlet has a height to width ratio of substantially 1.5 to 2.

10. The cylinder head of claim 8, where the first and second inner exhaust runners are directed in a substantially straight path to the exhaust outlet.

11. The cylinder head of claim 8, where the exhaust outlet has at least one radius of at least 8 mm.

12. The cylinder head of claim 8, further comprising a boss for an oxygen sensor positioned in a collector, the collector positioned downstream of the first valve guide entry point and upstream of the exhaust outlet.

13. The cylinder head of claim 12, where the exhaust outlet includes a turbocharger mounting boss.

* * * * *